United States Patent [19]

Plantier

[11] Patent Number: 4,885,879

[45] Date of Patent: Dec. 12, 1989

[54] VAULT STRUCTURE FOR PROTECTION OF ROADWAYS AGAINST SNOW

[76] Inventor: Jean-Louis Plantier, Chemin du Buloz, Saint-Jorioz (Haute-Savoie), France

[21] Appl. No.: 154,781

[22] Filed: Feb. 10, 1988

[30] Foreign Application Priority Data

Feb. 10, 1987 [FR] France ..... 87 02032

[51] Int. Cl.[4] ..... E04B 1/12

[52] U.S. Cl. ..... 52/63; 52/86; 52/299

[58] Field of Search ..... 52/80, 84, 85, 86, 299, 52/298, 297, 296, 295, 294, 293, 292, 63

[56] References Cited

U.S. PATENT DOCUMENTS

| | | | |
|---|---|---|---|
| 2,801,716 | 8/1957 | Colby, Jr. | 52/86 X |
| 4,121,604 | 10/1978 | Rain | 52/63 X |
| 4,416,928 | 11/1983 | Carl | 52/63 X |
| 4,649,676 | 3/1987 | Davey | 52/86 |

*Primary Examiner*—David A. Scherbel
*Assistant Examiner*—Creighton Smith
*Attorney, Agent, or Firm*—Herbert Dubno

[57] ABSTRACT

A roadway protection against snow or the like comprises a vault structure having a skeleton formed by dismountable arches provided with a ventilated covering.

11 Claims, 5 Drawing Sheets

VAULT STRUCTURE FOR PROTECTION OF ROADWAYS AGAINST SNOW

FIELD OF THE INVENTION

My present invention relates to a vault structure for the protection of roadways against snow, surface icing and snow accumulations.

BACKGROUND OF THE INVENTION

In the past various techniques have been used to make sensitive roadways and the like against extreme weather conditions and particularly winter weather conditions such as snow and ice accumulation, the covering of the roadway in mountainous areas and even avalanches.

In general, such systems have utilized permanently emplaced concrete vault structures which are not dismountable, removable or otherwise capable of disassembly.

As a consequence, the cost of fabrication of roadway protectors of this type is high and it is not possible to remove the protector from the roadway when conditions no longer require it so as, for example, to permit viewing of the landscape.

OBJECTS OF THE INVENTION

It is the principal object of the present invention to provide a roadway protector for the purposes described which is free from the drawbacks of permanently-emplaced concrete roadway protectors and tunnels.

Another object of this invention is to provide a low-cost dismountable structure which can be easily removed and disassembled, for protecting a roadway, especially against snow accumulations.

SUMMARY OF THE INVENTION

These objects and others which will become apparent hereinafter are attained, in accordance with the invention in a vault structure for temporarily covering a roadway and protecting it from snow, especially falling snow, which comprises an armature or skeleton composed essentially of a plurality of independent stirrup-shaped arches whose free ends form legs adapted to straddle a roadway and fixed vertically to the ground so that these arches extend over the surface to be protected from snow, and a ventilated covering placed on a fixed-to-the-armature or skeleton so as to cover the latter at least in part, i.e. completely or partially.

The light weight structure thus resulting makes it possible to fix the snow which rapidly collects upon the surface covering and can support even relatively thick snow coverings because of the vault construction of the roadway protector. The structure is autostable in the sense that, as a vault structure, its stability increases as the load thereon increases within the limits of the structural strength of the arches.

The attachment of the legs of the arches, i.e. the free ends thereof to the ground and the attachment of the ventilated covering to the arches can be effected in a detachable manner to allow the vault structure to be taken down and stored in a convenient manner in a small space.

Because the vault structure of the invention is of light weight and easily disassembled, it is also fabricated at low cost and can be erected before the start of the winter season and removed when the danger of snow is passed so that the vault structure does not interfere with panoramic views or the like. The vault structure of the invention also has advantages with respect to the simplicity of erection, ease of adaption to particular roadway patterns, etc.

According to a feature of the invention, the ventilated covering comprises at lease one metal latticework having a square mesh which may be 5 cm on a side and covered by a sheet or web which constitutes the barrier to snowflakes and can be constituted of a material of lower strength than that of the latticework, e.g. of plastic (synthetic resin) sheet.

Because the vault structure is covered by a ventilated covering, i.e. one which permits air and light to pass through, the layer of snow which may accumulate on this covering also is exposed to air both from above and below, favoring the rapid dissipation of this layer in a manner far more favorable than can be achieved with an impermeable layer upon which a melting of the snow takes place.

Advantageously, each arch is constituted by a bent metal profile of H cross section which is comparatively easy to bend. Each arch may be formed in one piece or from a plurality of bent sections, connected together end-to-end so as to be disassemblable or connected in a permanent manner.

Preferably each arch leg is fixed to the ground by a prefabricated concrete footing block or the like which is preformed with a seat, e.g. a frustopyramidal recess, in which the leg or end of the arch is received and held by a body of mortar cast in place and with or without the application of demolding coating on the seat so that the result is the dismountable connection of the arch to the footing block or a permanent connection therebetween.

Advantageously, each footing block is provided with two such seats, each receiving a leg or end of one of a pair of arches, so that the arches are provided with pairs having common footing blocks.

The footing blocks, of course, require preparation of support surfaces adjoining the roadway, i.e. extending along the opposite longitudinal edges thereof. These support surfaces can be formed by a pair of trenches, the bottom of which can be formed by a layer of soil on which the footing blocks can rest directly, or via a bed of mortar forming the foundation.

In the first case, the attachment of the footing blocks to the ground is completed by spikes driven into the ground and traveling members provided at the ends of the arches, e.g. the aformentioned blocks. In the second case, the footing blocks are cemented or bonded to the bed of mortar, e.g. by a hydraulic cement.

To facilitate the extraction of each arch leg from the respective seat, with or without the body of mortar cast around the leg therein, each leg can be provided with a transverse plate which has one or more holes engageable by a spoke, pin or bolt by which the leg can be supported for extraction of the leg form the footing block.

When the arches are connected in pairs, at least the arches of each pair at each end of the vault structure are provided with cross braces to prevent tilting of the structure.

I can also improve the rigidity of the structure by interconnecting the summits of the two arches of each pair by a brace extending longitudinally of the structure and by providing further braces between summits of successive pairs of arches so that these braces form a ridge line for the armature or skeleton.

In this case, advantageously, each arch can be constituted by two identical sections connected end-to-end at the summit of the arch. According to another feature of the invention, designed to facilitate mounting and dismounting of the vault structure, each metal latticework forming the ventilated covering is constituted by a plurality of lattice elements in overlapping relationship as with roof shingles.

It should be apparent from the foregoing that the vault structure of the invention is not only of light weight, but is easily and economically fabricated and can satisfy the requirements for roadway covering not only against heavy snow falls, but also against avalanche and freezes. Of course, the vault structure is suitable for protecting particularly exposed roadways and also can be utilized to protect parking areas, tracks above a roadway or other regions requiring such protection. The fact that the structure can be easily taken down and stored during periods without snow, frees the roadway from unesthetic encumbrances to panoramic views.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
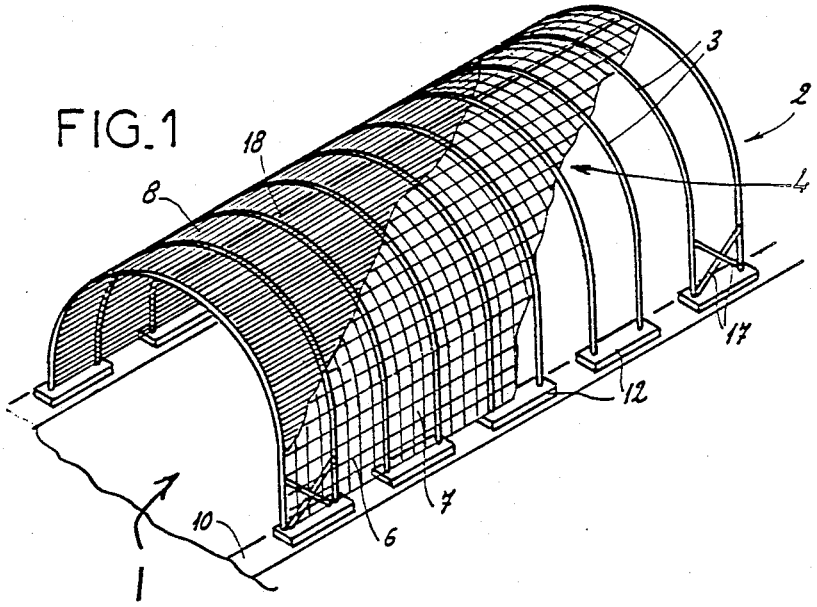
FIG. 1 is a perspective view, partially broken away of a vault structure according to the invention.

The vault structure (FIG. 1) of the invention is constituted by an armature or skeleton 2 which is constituted by arches 3 having the shape of stirrups and spaced apart along a roadway 1 so as to span over this roadway. The arches 3 are shown to be constituted in one piece in FIG. 1 but in practice may be composed of a plurality of elements connected together in end-to-end relationship as seen in FIGS. 2 ff.

The stirrup-shaped arches 3 are covered by at least one first latticework 6 forming generally square mesh 7 of a side length of about 5 cm, and covered in turn by a second ventilated layer 8 of lesser mechanical strength with much smaller mesh such as a plastic screen.

If it is not possible to obtain a latticework 6 with a mesh side of about 5 cm, it is possible to use a latticework having a mesh side of 10 cm and to provide two such latticeworks in superposed relationship but offset diagonally from one another so that the effective mesh size formed by the two metal latticeworks *6a* and *6b* will be 5 cm on a side.

Whether the arches 3 are formed in a single piece or assembled from a plurality of sections in end-to-end relationship, they are composed of H-section steel or aluminum beams which are easy to bend in the plane of the web of the H seciton.

Figure 3:
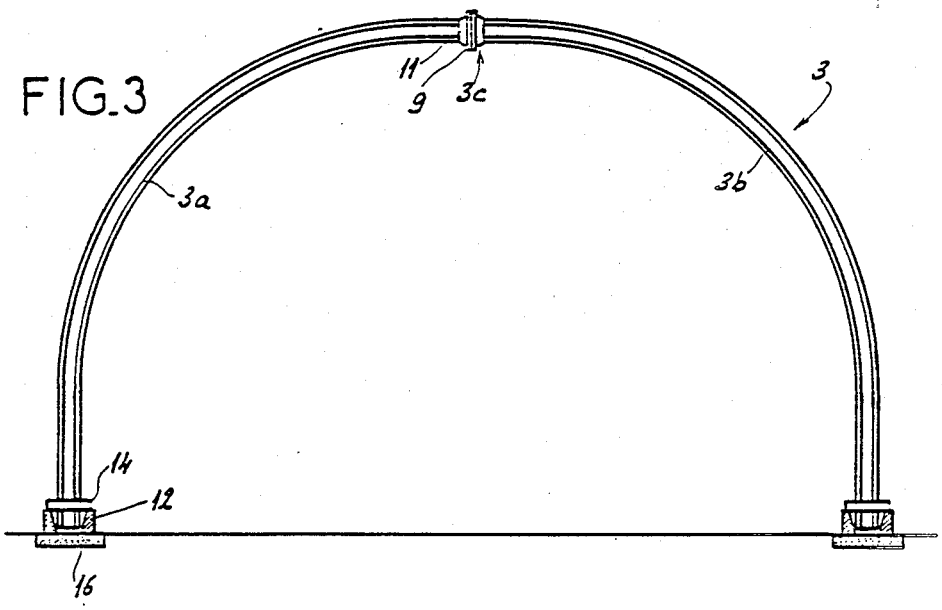
FIG. 3 is a vertical end section through the vault structure omitting the ventilated covering.

As can be seen from FIGS. 3 ff, each arch 3 can be 25 constituted by two identical sections *3a* and *3b*, each of which constitutes a half arch and which are assembled at the summit *3c* of each arch 3.

Figure 5:
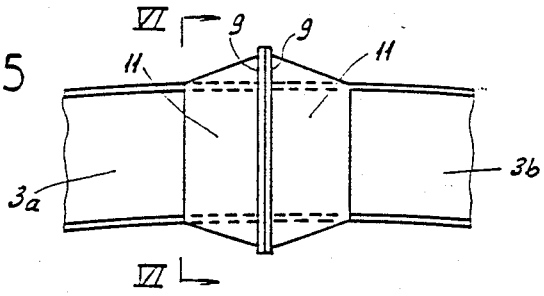
FIG. 5 is a detail view in elevation in the direction of arrow 5 in FIG. 2 showing the assembly of two arch sections into a single arch element of the invention.
Figure 6:
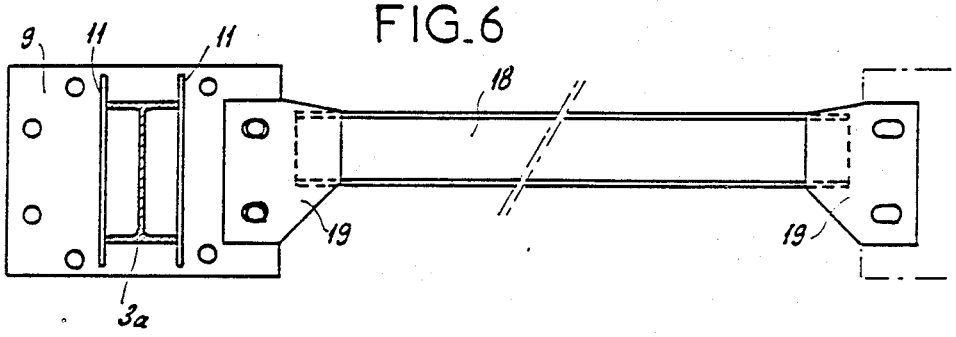
FIG. 6 is a sectional view taken along the line VI—VI of FIG. 5 showing the connection between pairs of arches.
Figure 7:
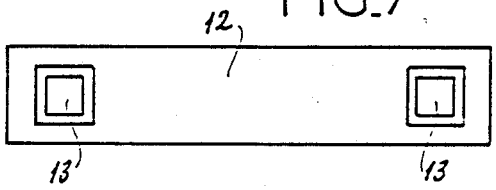
FIG. 7 is a top plan view of a footing block.

As can be seen more specifically from FIGS. 5 and 6, to permit such assembly end-to-end of the sections *3a* and *3b* of an arch, each section is provided with a transverse plate 9 forming an assembly flange which can be vaulted or welded to the other flange. The flanges may be reinforced by lateral gussets which may be likewise welded in place.

Figure 4:
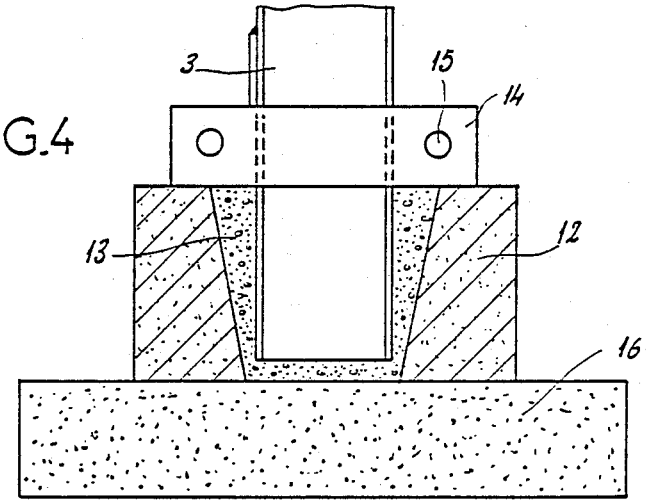
FIG. 4 is a detail section drawn to a larger scale, showing the use of a floating block according to the invention.

Each arch 3 of the armature 2 can be fixed vertically at its free extremities or legs, permanently or removably to a footing block 12 prefabricated of concrete (FIG. 4.) Preferably as shown in the drawing, each footing block 12 is provided to support two arches 3 so that the arches 3 are associated in pairs, interconnected by footing blocks on opposite sides of the roadway.

As had also been shown more particularly in FIGS. 4–7, each footing block 12 is a rectangular parallelepiped of concrete which is elongated in the direction of travel and toward each one of its ends has a respective upwardly open seat 13 formed as a frusto-pyramidal recess adapted to receive one of the legs of an arch of the respective pair.

Each arch leg is provided with a lateral plate 14 whose length is greater than the width of the respective seat 13 so that the plates 14 support the legs in the recesses to permit bodies of mortar to be cast in the recesses around the legs. Each of the plates 14 is also provided with at least one hole 15 adapted to receive a pin enabling the arch to be held while the footing block 12 is detached, e.g. by a blow to the latter.

The mortar or cement filling each seat 13 can be introduced after the seat has been coated with oil, silicone or like demolding coating to permit separation of the footing block form the arches.

In order to properly mount the footing blocks 12 of each pair of arches along the roadway, it is necessary to prepare the ground and to that end a pair of parallel trenches 10 are formed in the ground with a mutual spacing corresponding to the width of the arches, the trenches having their bottoms properly leveled so that there will be an appropriate alignment of the successive pairs of arches constituting the armature.

Figure 10:
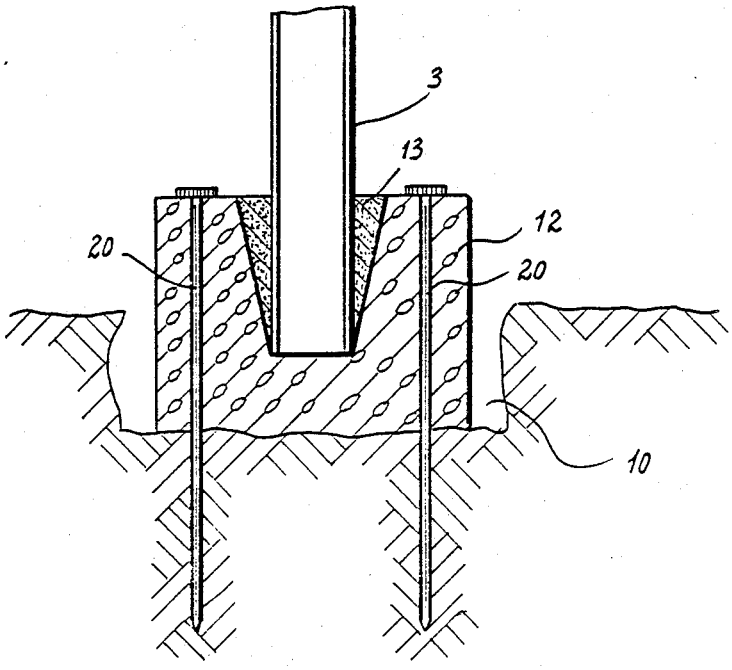
FIG. 10 is a detail section showing another mode of attachment of the arches to the ground.

The footing blocks 12 can be positioned directly on the ground in a respective trench 10 (FIG. 10) and held in place by spikes 20 or can be cemented to a layer of mortar or concrete 16 which has previously been cast in the trench to form a foundation.

Figure 2:
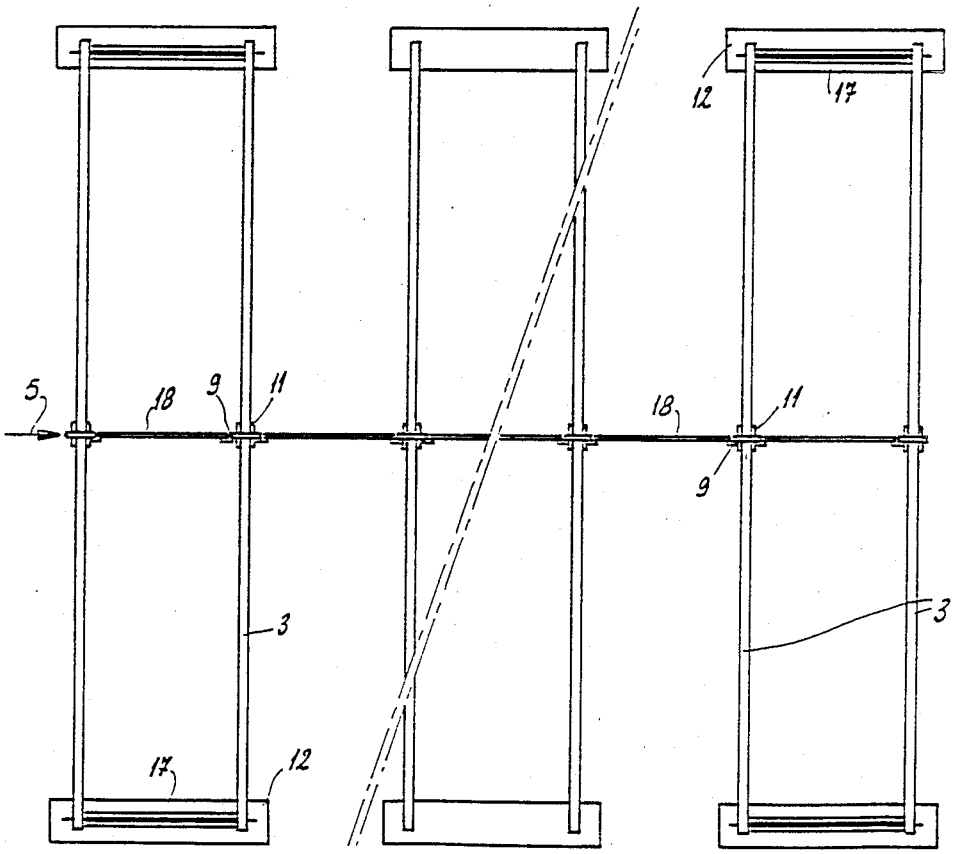
FIG. 2 is a top plan view of a vault structure armature or skeleton from which covering has been removed or onto which the covering has not yet been applied.

To stabilize the vault structure against undesired inclination, it is sufficient to provide cross braces 17 between the arches 3 of the pairs at either end of the vault structure (FIGS. 1 and 2). However, cross braces can be provided between additional pairs of arches if desired as well. The cross braces may be connected to the arches by bolts or the like.

In order to increase the rigidity of the armature and also to facilitate attachment and support of the ventilated covering, the summits 3c of each arch 3 can be connected to the summit of the next arch by a longitudinal brace 18. Each brace 18, therefore, may either bridge the braces of a respective pair or successive pairs of braces. Advantageously, such braces 18 are provided the full length of the vault structure and form a ridgeline . To permit the braces to be attached conveniently, each brace 18 (FIG. 6) is provided with a connecting plate 19 which can be bolted to the plates 9 previously described in an removable or detachable manner.

After the armature or skeleton 2 has been erected, it can be provided with its ventilated covering in the manner described previously, i.e. by applying to latticework 6a and 6b which may be offset diagonally and then attaching a plastic screen 8 thereto. The fine screen, which can have low mechanical strength, is supported by the large-mesh metal latticework 6a and 6b and need only serve as a collector for the snowflakes.

Figure 8:
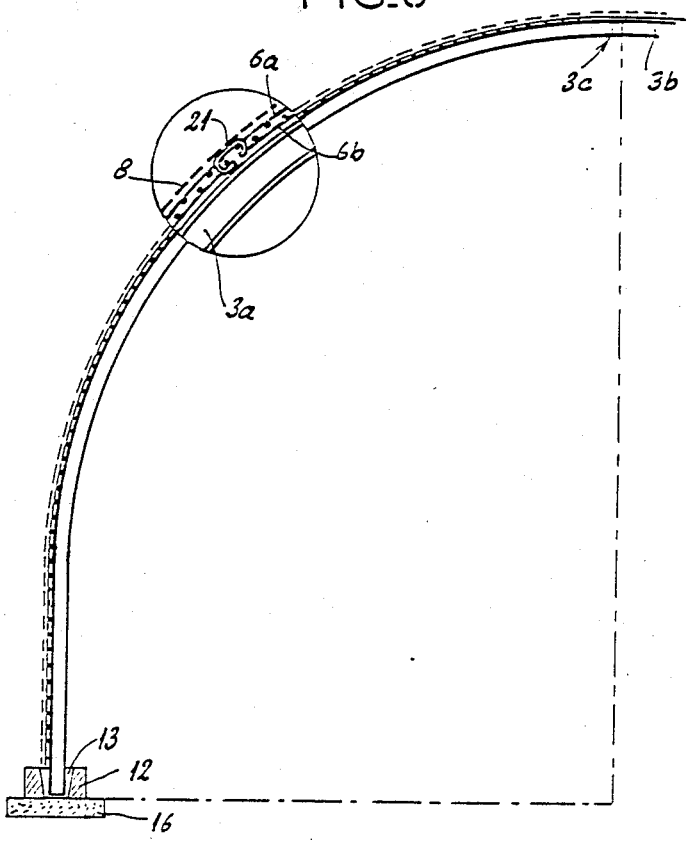
FIG. 8 is a partial sectional view similar to FIG. 3 showing in an enlarged region the attachment of the elements of the ventilating covering of the arches.
Figure 9:
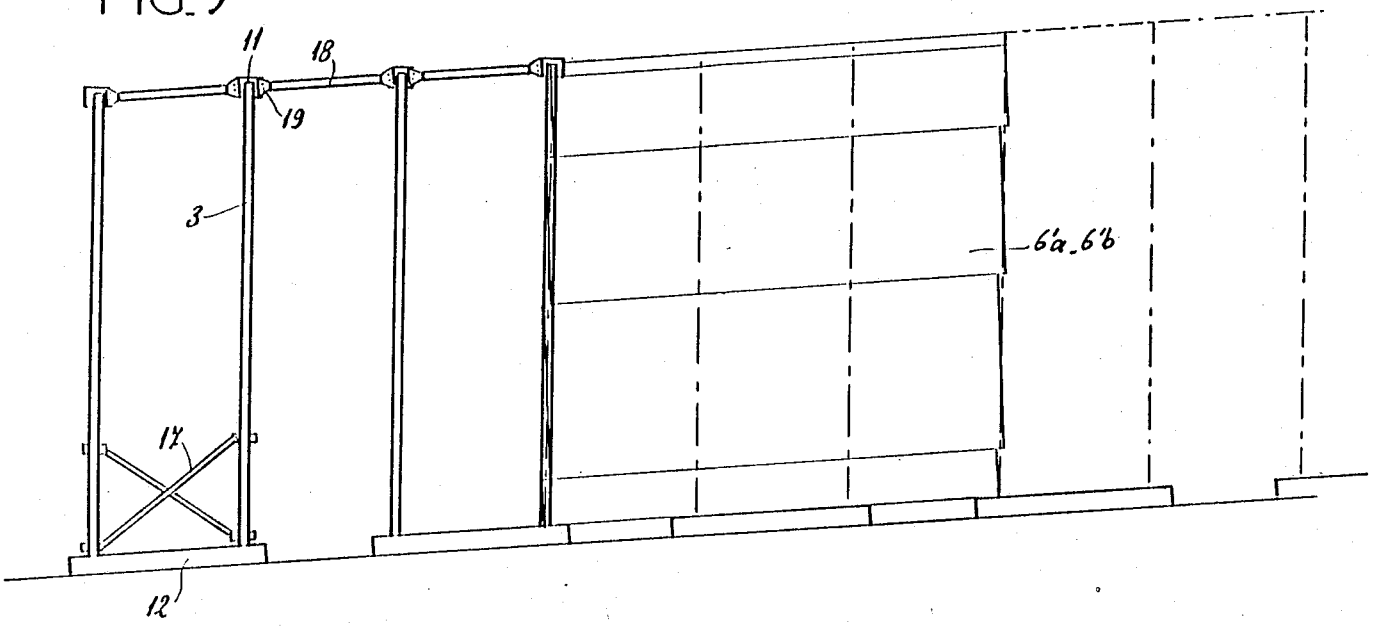
FIG. 9 is a partial side elevational view illustrating the disposition of the, covering elements on the armature or skeleton.

As can be seen particularly from FIG. 9, each metal latticework 6a, 6b is constituted from rectangular elements 6'a, 6'b which may be overlapped in a manner similar to that used in overlapping roof shingles. The elements 6'a and 6'b can be connected together by double-hook clips 21 having generally a C shape as shown in FIG. 8. The screen can be tied by wire or the like to the grillwork 6.

This structure can be easily adapted to all conditions of use and roadway configurations, thanks to the ease with which the elements of the armature can be positioned. The means required for erection and dismounting are simple and the structure can be easily taken down for periods in which snow is not be expected so that the vault structure need not provide esthetic problems in tourist areas.

I claim:

1. A vault structure for the protection of a roadway against snow, comprising:

a pair of support surfaces flanking a roadway to be protected from snow accumulation;

a multiplicity of spaced-apart generally stirrup-shaped arches extending over said roadway and having free ends supported on opposite ones of said surfaces, said arches forming a vault skeleton;

a ventilation layer on said skeleton at least partially covering same and open to passage of air while preventing snowflakes from depositing through said structure on said roadway; and means for detachably fixing said free ends of said arches on said support surfaces, ends on said support surface including a footing block of concrete provided with an upwardly open seat receiving the respective arch end, and a body of cementatious material filling the seat and bonding each said end to the respective block.

2. The vault structure defined in claim 1 wherein each of said block is formed with two said seats each receiving one end of a respective arch whereby said arches are provided in pairs, each having a respective footing block on opposite sides of said roadway coupling the arches of the pair together.

3. The vault structure defined in claim 2 wherein each of said ends is formed with a vertical lateral plate formed with at least one hole engageable by a pin permitting separation of the respective end from the respective block.

4. The vault structure defined in claim 2, further comprising crossbracing interconnecting the pairs of arches at least at opposite ends of the vault structure against inclination of said arches at said opposite ends of said structure.

5. The vault structure defined in claim 2, further comprising a connecting brace joining together apexes of the arches of each pair.

6. The vault structure defined in claim 5, further comprising further braces joining apexes of said pairs of arches together, whereby said braces form a ridgeline of the vault structure.

7. A vault structure for the protection of a roadway against snow, comprising:

a pair of support surfaces flanking a roadway to be protected from snow accumulation;

a multiplicity of spaced-apart generally stirrup-shaped arches extending over said roadway and having free ends supported on opposite ones of said surfaces, said arches forming a vault skeleton; and a ventilation layer on said skeleton at least partially covering same and open to passage of air while preventing snowflakes from depositing through said structure on said roadway, said support surfaces being formed by respective trenches formed in the ground alongside said roadway and transversely spaced across said roadway by a distance equal substantially to the width of one of said arches.

8. The vault structure defined in claim 7 wherein each trench has a soil bottom and said ends of said arches are secured in said trenches by spikes.

9. The vault structure defined in claim 7 wherein said trenches have a layer of mortar on their bottoms, said ends of said arches being supported on said layer of mortar.

10. A vault structure for the protection of a roadway against snow, comprising:

a pair of support surfaces flanking a roadway to be protected from snow accumulation;

a multiplicity of spaced-apart generally stirrup-shaped arches extending over said roadway and having free ends supported on opposite ones of said surfaces, said arches forming a vault skeleton; and a ventilation layer on said skeleton at least partially covering same and open to passage of air while preventing snowflakes from depositing through said structure on said roadway, said ventilation layer comprising at least one metal latticework having a generally square mesh of about 5 cm on a side, covered by a web of a material having openings sufficiently small as to block the passage of snowflakes, a plurality of said latticeworks being provided in overlapping relationship in a roof-shingle pattern, said latticeworks being removably attached to said skeleton and said web is removably attached to said latticework, each of said arches is formed from a pair of identical sections secured together end-to-end at a ridgeline of said vault structure, said means for detachably fixing each of said free ends on said support surface includes a footing block of concrete provided with an upwardly open seat receiving the respective arch end, and a body of cementatious material filling the seat and bonding each said end to the respective block, said bodies of cementatious material being removable from said seats, each of said blocks is formed with two said seats each receiving one end of a respective arch whereby said arches are provided in pairs, each having a respective footing block on opposite sides of said roadway coupling the arches of the pair together, said structure further comprising a connecting brace joining together apexes of the arches of each pair, and further braces joining apexes of said pairs of arches together, whereby said braces form said ridgeline of the vault structure.

11. The vault structure defined in claim 10 wherein said seats are frustopyramidal.

* * * * *